US005483816A

United States Patent [19]

Nayer et al.

[11] Patent Number: 5,483,816

[45] Date of Patent: Jan. 16, 1996

[54] PROCEDURE FOR ESTABLISHING THE SCANNING RANGE OF VEHICLE-ACTIVATED MEASURING EQUIPMENT, AS WELL AS EQUIPMENT FOR THE ADJUSTMENT AND TUNING OF MEASURING EQUIPMENT ON TRACKS RELATIVE TO SENSORS

[75] Inventors: Wolfgang Nayer, Zeltweg, Austria; Josef Frauscher, Rumstorf, Germany

[73] Assignee: VAE Aktiengesellschaft, Vienna, Austria

[21] Appl. No.: 352,582

[22] Filed: Dec. 9, 1994

[30] Foreign Application Priority Data

Dec. 10, 1993 [AT] Austria ..... 2499/93

[51] Int. Cl.[6] ..... G01N 27/82

[52] U.S. Cl. ..... 73/1 R; 246/249; 324/226; 324/232

[58] Field of Search ..... 73/1 R, 1 DV, 73/118.1, 636; 324/217, 200, 226, 232, 202; 246/249

[56] References Cited

U.S. PATENT DOCUMENTS

| | | | |
|---|---|---|---|
| 2,973,430 | 2/1961 | Pelino | 246/249 |
| 3,016,457 | 1/1962 | Brown et al. | 73/593 |
| 3,721,859 | 3/1973 | Blanyer | 246/249 |

*Primary Examiner*—Robert Raevis
*Attorney, Agent, or Firm*—Cushman Darby & Cushman

[57] ABSTRACT

An adjustable scanning range is provided for vehicle-activated measuring equipment of the type which includes receiver coils positioned on opposite sides of a transmitter such that voltages induced in the received coils from the transmitter are altered as the vehicle passes, the measuring occurring through the application of the induced voltages to a comparison circuit. Altering the input(s) to the comparison circuit by a constant voltage value allows the scanning range to be adjusted.

4 Claims, 2 Drawing Sheets

PROCEDURE FOR ESTABLISHING THE SCANNING RANGE OF VEHICLE-ACTIVATED MEASURING EQUIPMENT, AS WELL AS EQUIPMENT FOR THE ADJUSTMENT AND TUNING OF MEASURING EQUIPMENT ON TRACKS RELATIVE TO SENSORS

BACKGROUND OF THE INVENTION

1. Field of the Invention

The invention has to do with a process for establishing the scanning range of vehicle-activated measuring apparatuses, such as a hot axle detecting apparatus, in which a wheel sensor is fitted with a transmitter and two receivers arranged on either side of the transmitter, whereby the signals of both receivers are compared with one another, and a measurement is made which depends on the result of the signal comparison. The invention also has to do with an apparatus for the adjustment and correction of measuring apparatus on tracks relative to wheel sensors with a chassis, on which the wheel sensors and measuring apparatus can be set at a geometrically defined distance from one another, where the wheel sensors each have a transmitting coil and two receiving coils.

2. The Prior Art

In hot axle detectors until now, wheel sensors have been used whose sending or receiving units are mounted on both sides of the head of the rail. By these well-known arrangements, the transmitter signal, which is influenced by the wheel and in turn is detected by the receiver, is transformed on reaching a definite threshold value by means of an evaluator switch into a gate opening signal for the hot axle detector. This gate opening signal is influenced greatly by the speed of the vehicle or the temperature of the surroundings. This leads to delays in the gate opening and closing signals, as a result of which the exactness of the measurement of the parts to be checked, such as the wheel bearings especially, suffers.

With the wheel sensor elements set on both sides of a rail head,-placement of the hot axle detector in a location where the wheel sensors also determine exactly the overshooting of a wheel is not possible, for reasons of space.

From EP-A 340 660, wheel sensors have become known which are distinguished by the fact that they can be set on only one side of the head of a rail. The wheel sensors disclosed in EP-A 340 660 consist of a coil system which can be mounted, for example, on the inner side of a rail of the track, with a transmitter coil fed by alternating current and two receiver coils to go with it. The transmitter coils induce a voltage in the receiver coils. When one receiver coil is aligned before and the other after the transmitter in the direction of the rail, then if the receiver coils are identically formed and set at equal distance from the transmitter coil, and identical voltage is induced in both receiver coils, it can be concluded that a wheel is running over the middle of the sensor. An electrical evaluator for signals of this kind of sensor has already been proposed in EP-A 340 660; and it is possible with a signal intersection evaluating circuit of this kind to locate exactly the center of the wheel, or the wheel's axis. Through the exact determination of a geometrical location of the wheel which is made possible in this way, the hot axle detector can also be exactly adjusted; at the same time, and because only one side of the rail head is needed for the setting of the necessary elements for a sensor of this kind, an exact geometrical correlation can also be maintained.

An exact measurement requires not only a geometrically unambiguous positional location for the ranges to be measured by the hot axle detector. Just as necessary is the establishment of a gate opening or closing signal, with which the moment of measurement is clocked exactly in relation to the spatial geometry of the measurement. Therefore, in the equipment known up to now, two wheel sensors are set to generate the gate opening and closing signal. Wheel sensors of this kind must be adjusted lengthwise along the rail, whereby the corresponding settings can only be varied to a limited extent due to mechanical distortion of the setting.

SUMMARY OF THE INVENTION

The present invention is intended to create a process of the kind described above which, with the given geometrical ordering of the individual parts for vehicle-activated measuring apparatus, especially hot axle detecting apparatus, it is possible after completing all mechanical adjustments to make additional fine-tuning, without this resulting in an increase in the cost affixing the parts of such a vehicle-activated measuring apparatus. With a simple mechanical setting of the parts, an adequate measurement is achieved, yet additional adjustability is possible.

For the solution of this problem, the inventive procedure consists essentially in this: an adjustable, constant signal is electrically added to or subtracted from at least one of the signals of the receivers of a wheel sensor; and the measurement taken evaluates the comparison of the signals which are thereby developed by the receivers of the wheel sensors. Because an adjustable constant signal is electrically added or subtracted to at least one of the signals of the receivers of the wheel sensor, the procedure described in EP-A 340 660 for determining a signal intersection point allows itself to be changed with the passage of time, so that this intersection point can be moved. For example, the signal which is altered by the addition of an electrical signal from one of either of the receiver coils results in the moving of the intersection of the voltage curves of the two receiver coils, by which an electrical fine-tuning of the intersection is made possible. The moving of the intersection by electrical addition or subtraction of an constant amount has as a consequence that the gate opening or closing signal can be correspondingly moved. By moving gate opening and closing in the same or opposite directions, the gate as a whole can be moved, or the width of the gate can be regulated, whereby an additional high measure of adjustability is obtained.

The invention is characterized by the fact that at least one voltage signal of one receiver coil is supplied to a calculator circuit, and that the output signal of the calculator circuit as well as the voltage signal of the second receiver coil is supplied to a comparator, whose output signal is connected with the measuring equipment. Through the calculator circuit, a modified signal of one receiver coil is formed and, in comparing it with the induced voltage in the second receiver coil, the displacement of a parameter which is relevant to the evaluation, such as the intersection of both signal curves with the given correlation or identity of the signals, is achieved. For implementing the invention, a simple calculator circuit is adequate, whereby the design is made in such an especially, simple way that the calculator circuit is constructed as an additional circuit, and that to the input signal an adjustable voltage value is added or subtracted which value can be multiplied or divided by an adjustable factor. An adjustable voltage signal can be arrived at in a simple way through conventional circuits. Usually, a voltage signal of this kind can be generated as a voltage drop across a defined resistance, whereby adjustability is possible, for example, with simple potentiometers. In a simple and conventional way the desired voltage can be varied at any time, and consequently the voltage selected at any time can be kept constant, making possible an especially simple additional adjustment, which exerts no negative influence on the costs of the measuring equipment.

As befits an especially simple and safe-to-operate design, the equipment can be constructed in such a way that the calculator circuit contains an operational transductance amplifier, at whose inputs the signal of one receiver coil and a voltage source with adjustable voltage are attached.

BRIEF DESCRIPTION OF THE DRAWINGS

The invention is subsequently explained more closely in greater detail by means of the accompanying drawings wherein.

DETAILED DESCRIPTION OF THE INVENTION

Figure 1:
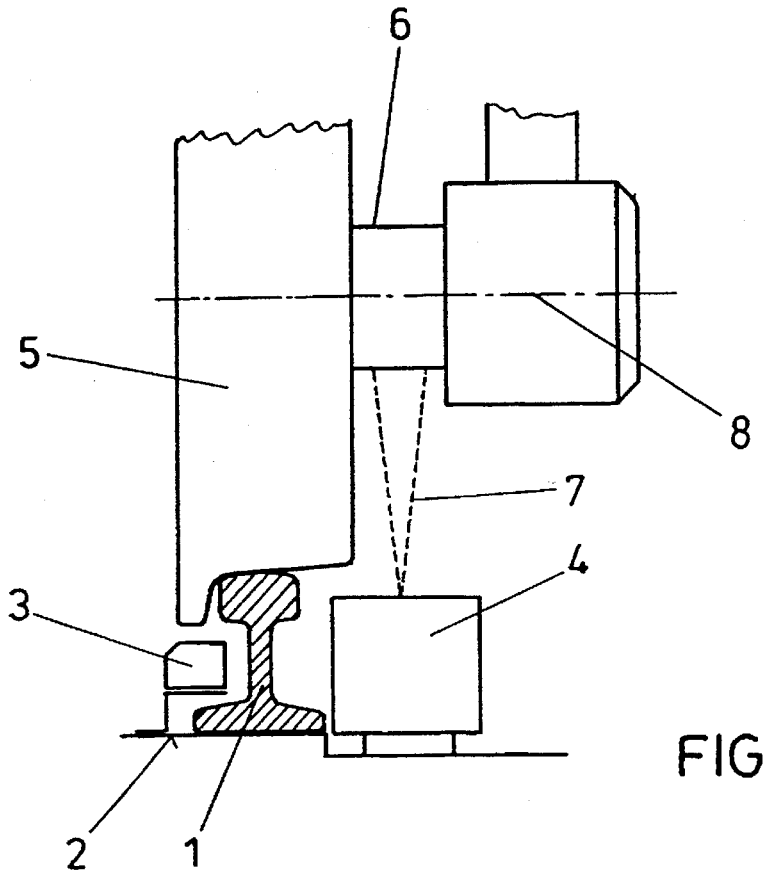
FIG. 1 schematically illustrates the arrangement of the vehicle-activated measuring equipment lengthwise along the rail, with the rail in section.

In FIG. 1 a rail 1 is shown whose base is connected with a mounting plate 2. On the inside of the rail, a wheel sensor 3 is set. The construction of the wheel sensor is so chosen that it is set on one side of the upright part of the rail, so that on the other side of the upright a hot axle locator 4 can be set. On the rail, a wheel 5 is schematically shown rolling over the wheel sensor 3, with a wheel's axle 6 entering the detection range 7 of the hot axle detector 4. Analogously, over a wider scanning range, the bearing temperature of the wheel's bearing 8 can also be scanned.

Figure 2:
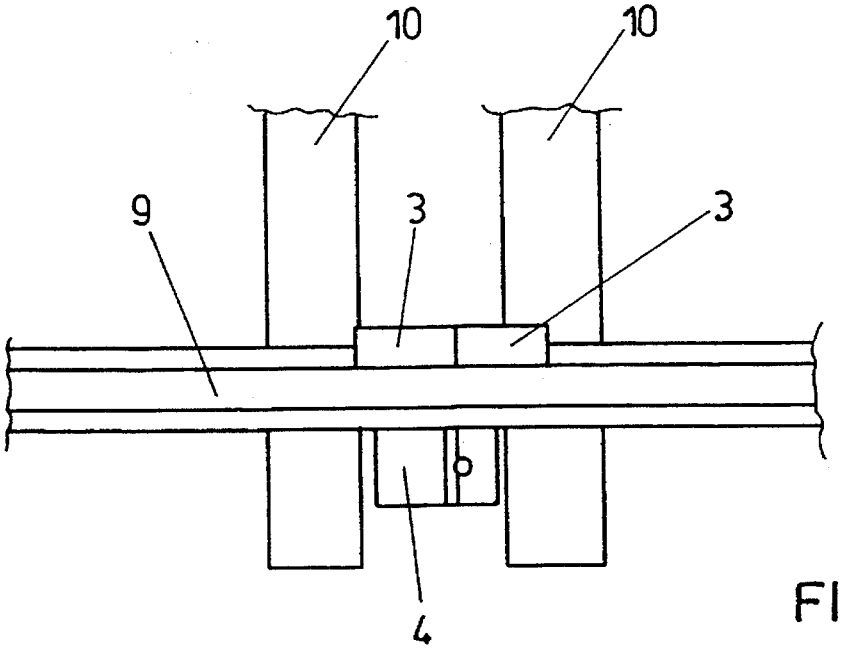
FIG. 2 shows a top view of the measuring equipment illustrated in FIG. 1.

As is evident from the portrayal in FIG. 2, on the inner side of the rail head 9 the sensor 3 shown in FIG. 1 actually is a combination of two wheel sensors 3. On the outer side of the rail the hot axle locator 4 is fixed in a spatially exactly adjusted way on the same mounting plate as the wheel sensors 3. The space available is limited through adjacent crossties 10.

Figure 3:
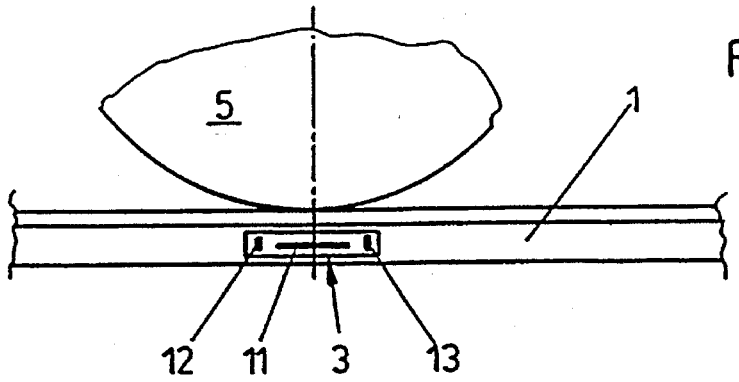
FIG. 3 shows a detailed view of the wheel sensors as seen from the inner side of the track.
Figure 4:
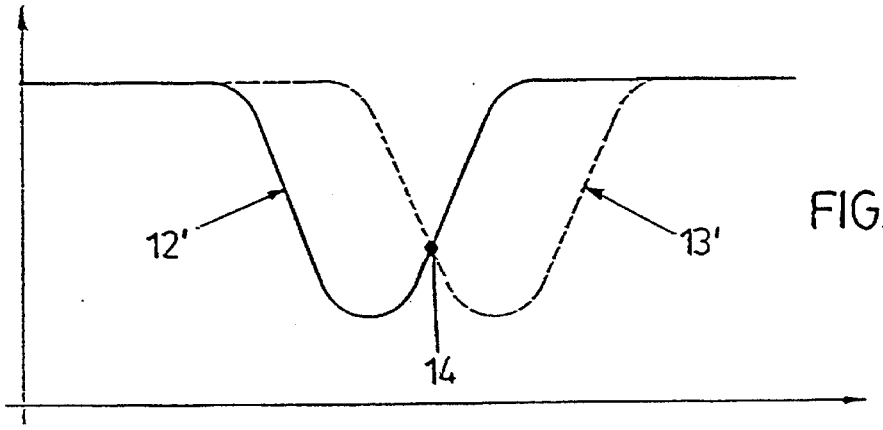
FIG. 4 shows the signal curve as can be obtained with the wheel sensors according to FIG. 3 without modifying the signal.

As is evident from FIG. 3, a wheel sensor consists of a central transmitter coil 11, with receiver coils 12 and 13 set on opposite sides, extending lengthwise along the rail. As is elaborated in EP-A 340 660, the coil axes are pointed at the base of the rail, which thus acts as a damping metal surface in the effective range under the receiver coils 12 and 13. With the correct setting, the axes pass by the rail head, and are pointed towards the expected range of passage of the rim of the wheel 5. As long as no wheel 5 is in effective range, the largest possible output signals occur in both receiver coils.12 and 13. If a wheel 5 with its wheel flange enters the effective range above the receiver coils 12 and 13, a damping comes into effect, which has as a consequence a decrease in the output signals of either receiver coil 12 or 13. The signal curves of the induced voltages in the receiver coils 12 and 13 are shown in FIG. 4 and marked with 12' and 13'. In comparing the signals of the coils 12 and 13 in an evaluator circuit, an exact intersection point 14 can be ascertained, which spatially and temporally coincides with the point at which the wheel's axle is found in the middle above the two receiver coils 12 and 13 and the transmitter coil 11.

Figure 5:
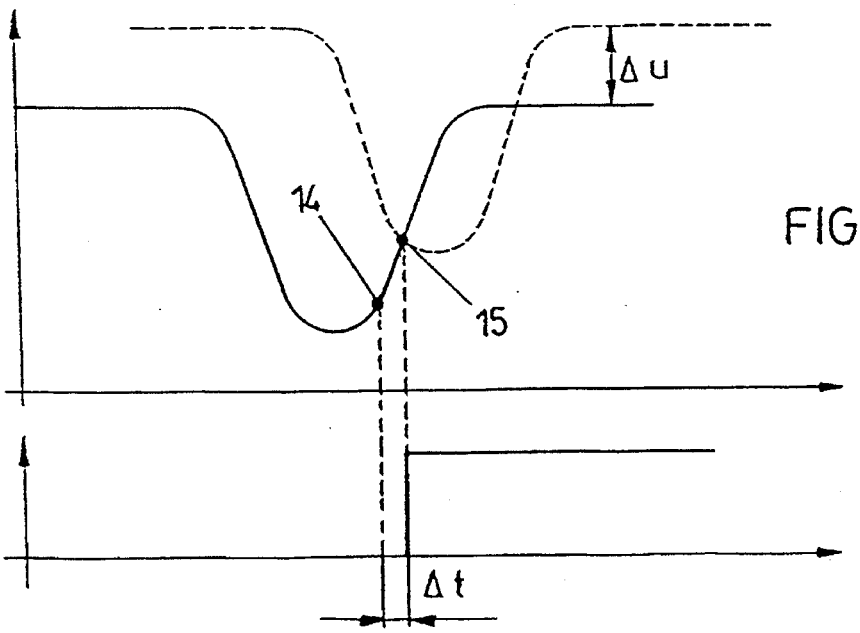
FIG. 5 shows the signal curve after electrical fine-tuning or modification of the signals as they were originally obtained as portrayed in FIG. 4.

A fine-tuning of this exactly defined spatial reference point, as it is given through the intersection point 14 of the signal curves of the induced voltages in coils 12 and 13, can be attained by modifying the signal of one of the two receiver coils. In an especially simple way, a predetermined adjustable voltage value can simply be added to the signal of one of the two receiver coils. According to FIG. 5, a constant amount of this kind is added to the signal of receiver coil 13, through which in total the signal after addition of the constant equal amount increases by the quantity $\Delta u$. This voltage difference can be obtained by a simple potentiometer and can, for example, be applied to the input of an operational transductance amplifier, to whose second input the original signal of coil 13 is applied. From raising by an equal amount the level of the signals measured in receiver coil 13, a displacement of the original intersection point at which equality of signals was established to a new intersection point 15, is produced with a change of time $\Delta$ to between points 15 and 16.

Through this temporal displacement $\Delta t$, which is attained through the addition of a constant voltage to the signal of one of the receiver coils, a new switch threshold can be exactly set; and $\Delta t$ can be adjusted and set in a wide range dependent on $\Delta u$, that is, depending on the added voltage. Through the addition of a constant voltage to the signals of receiver coils of a wheel sensor, either the gate opening time in the case of displacement of the signal level of receiver coil 12, or the gate closing time in the case of addition of a voltage to the signal of receiver coil 13, can be correspondingly displaced. With simultaneous displacement of time points both in a first wheel sensor and a second wheel sensor, the total gate width can be regulated; and in total, exact temporal and spatial tuning for optimizing the moment of measurement can be attained, simply through changing electrical quantities.

The embodiments of the invention in which an exclusive property or privilege is claimed are defined as follows:

1. A method for adjusting the scanning range of vehicle-actuated measuring equipment of the type wherein receiver coils are positioned on opposite sides of a transmitter for inducing voltages in the receiver coils and a comparison circuit is employed for comparing outputs from the receiver coils, said method including the step of altering at least one of said receiver coil outputs by a constant voltage of adjustable level.

2. Apparatus for adjusting the scanning range of vehicle-actuated measuring equipment of the type comprising: receiver coils positioned on opposite sides of a transmitter, said transmitter producing an output which induces voltages in the receiver coils; and a comparison circuit for comparing outputs from the receiver coils, said apparatus further comprising:

means for altering the output of at least one of said receiver coil outputs by a constant output of adjustable level prior to said altered output being applied to the comparison circuit.

3. Apparatus as set forth in claim 2, wherein said altering means is a calculator circuit capable of selectively producing an output of constant value greater or less than the receiver coil output applied to said calculator circuit.

4. Apparatus as set forth in claim 3, wherein said calculator circuit includes an operational amplifier having two inputs, one of said inputs being the output of one of said receiver coils and the other input being an adjustable voltage source.

* * * * *